United States Patent [19]

Benach et al.

[11] Patent Number: 4,736,660

[45] Date of Patent: Apr. 12, 1988

[54] ROTARY DIE-CUT APPARATUS AND GEARING ARRANGEMENT THEREIN

[75] Inventors: Douglas T. Benach, Lutherville; John R. Van Noy, Baltimore; Michael W. Millard, Baldwin, all of Md.

[73] Assignee: The Ward Machinery Company, Cockeysville, Md.

[21] Appl. No.: 866,068

[22] Filed: May 21, 1986

[51] Int. Cl.[4] ..... B31B 1/20

[52] U.S. Cl. ..... 83/174; 83/311; 83/347; 83/561; 493/355

[58] Field of Search ..... 83/347, 324, 74, 344, 83/561, 311, 174; 493/355, 354

[56] References Cited

U.S. PATENT DOCUMENTS

| | | | |
|---|---|---|---|
| 3,272,047 | 9/1966 | Ward . | |
| 3,565,006 | 2/1971 | Stewart . | |
| 3,882,745 | 5/1975 | Garrett et al. . | |
| 3,952,637 | 4/1976 | Lambert et al. . | |
| 4,063,493 | 12/1977 | McEvers | 83/347 X |
| 4,240,312 | 12/1980 | Ward . | |
| 4,295,843 | 10/1981 | Otomaru | 83/347 X |
| 4,331,053 | 5/1982 | Imai et al. | 83/347 X |

FOREIGN PATENT DOCUMENTS

| | | | |
|---|---|---|---|
| 0069017 | 1/1983 | European Pat. Off. | 83/347 |

OTHER PUBLICATIONS

Harmonic Drive Pancake Gearing Brochure (Emhart).

*Primary Examiner*—Donald R. Schran

*Attorney, Agent, or Firm*—Boyce C. Dent; Edward D. C. Bartlett

[57] ABSTRACT

A rotary die-cut apparatus, in which a die roll cooperates with a resiliently covered anvil roll for die-cutting carton blanks passed therebetween, incorporates a constant mesh gear train between the die roll and the anvil roll for providing an infinite hunting ratio between the rolls. This provides more uniform wear of the anvil roll cover and prolongs its effective life. Preferably, this gear train includes a harmonic drive having a wave generator cam rotatable by a trim motor. An arrangement for sensing changes in diameter of the anvil roll due to wear of its cover may provide an input for determining the speed of the trim motor. A resurfacing mechanism for removing the outer surface of the cover when worn may provide this input. A pulse generator is preferably incorporated in a controller of the trim motor for periodically making random changes in the speed of the trim motor. The gear train, with or without the trim motor, preferably has a gear ratio through multiple pairs of gears which itself provides an infinite hunting ratio. A gear on the anvil roll concentric therewith may mesh inside an internally toothed ring gear, these gears remaining in mesh when the anvil roll is moved about an eccentric axis towards or away from the die roll. An electric register for registering the die roll may be interconnected with the trim motor for rotation of the anvil roll with the die roll when the apparatus is stopped.

25 Claims, 7 Drawing Sheets

ROTARY DIE-CUT APPARATUS AND GEARING ARRANGEMENT THEREIN

FIELD OF THE INVENTION

This invention relates to rotary die-cut apparatus particularly for die-cutting sheets of paperboard and the like in the production of carton blanks. The invention is particularly concerned with the rotation of the anvil roll in relation to the die roll and a gearing arrangement between these rolls.

BACKGROUND OF THE INVENTION

In rotary die-cut apparatus, which may form a section of a flexographic printer die-cutter machine, a die roll carrying one or more die blades cuts paperboard sheets against a supporting anvil roll. The paperboard sheets are fed successively through a nip formed between the cooperating die and anvil rolls. Both the rolls are rotatably driven, usually the anvil roll being driven via gearing from the die roll. The anvil roll has a resilient cover into which the blade or blades of the die roll penetrate during the die-cutting of the sheets. Such die-cutting may comprise scoring the sheets, to form fold lines, and/or making complete cuts through the sheets. Usually the die blades are serrated. The penetration of these blades repeatedly into the resilient cover tend, in time, to cut and tear the surface of the cover. It then becomes necessary to replace this cover. During this wearing of the cover, the cover surface becomes irregular and the overall diameter of the covered roll reduces.

The anvil roll may be mounted in the frame of the machine such that it can be adjustably moved towards the die roll from time to time as the cover wears. Also, arrangements have been suggested and tried for rotating the anvil roll at a slightly different speed of rotation to the die roll. One such arrangement used is the "one tooth hunting ratio" whereby the die and anvil rolls are rotationally interconnected by a pair of gears, one of these gears having one gear tooth less than the other. For example, the die roll gear may have 131 teeth and the anvil roll gear 130. In this way the cutting pattern of the die blades into the anvil roll cover only starts repeating again after 130 revolutions of the anvil roll. This slows down the wear rate of the anvil cover. But as these rolls usually rotate at more than 100 rpm, for example 170 rpm, this repeating cutting pattern of the anvil roll cover occurs fairly frequently.

SUMMARY OF THE INVENTION

The present invention is concerned with reducing the rate of wear of the anvil roll cover, improving the life of this cover, and improving the interaction between the anvil and die rolls, separately or in combination with each other.

It is an object of the present invention to provide an infinite hunting ratio between the die and anvil rolls.

A feature by which this object is attained, is providing a harmonic drive in a gear train between the anvil and die rolls, and making random type speed changes to a trim motor having a rotary input into the harmonic drive to temporarily change the gear ratio thereof. This provides the advantage that small changes in rotational speed of the anvil roll relative to the die roll periodically occur to cause the die blades to gradually progress in cutting position relative to the periphery of the anvil roll cover. For example, about every 5 to 20 seconds the peripheral engagement position of the die blades could be moved 1 to 5 tousandths of an inch.

Another feature by which this object is separately attained, is the provision of a gear train between the die and anvil rolls having a plurality of pairs of gears of different gear ratios to provide the infinite hunting ratio, that is to provide an overall gear ratio which is a number having an infinite, or very large, number of decimal places. Preferably, this gear train includes two pairs of gears having close gear ratios and one or more pairs of gears having relatively wide gear ratios, and advantageously one of the gear pairs having a close gear ratio could be provided by a harmonic drive. This provides the advantage that the cutting pattern of the die blades on the anvil roll cover does not repeat, or relatively seldom repeats, during the effective life of the cover before replacement or resurfacing.

According to a preferred embodiment of the invention, both the above features are combined.

It is another object of the present invention to adjust the peripheral speed of the anvil roll to that of the die roll as wear of the anvil roll cover results in a reduction of diameter of the anvil roll.

A feature of which this latter object is achieved is the provision of a sensing arrangement for sensing, directly or indirectly, the diameter of the anvil roll and changing the gear ratio between the anvil and die rolls consequential upon the sensed diameter change as the anvil cover wears. For example, the position of the surface of the anvil roll cover can be sensed by sonar, by physically contacting that surface, or by sensing the position of the rotational axis of the anvil roll when adjustably moved towards the die roll for correct nipping disposition of the rolls. This has the advantage that die cutting quality is maximized by keeping the linear peripheral speeds of the rolls virtually the same. Advantageously, this sensing can be incorporated with a mechanism for removing the worn surface of the anvil roll cover in a resurfacing operation while the anvil roll is running. Preferably, the gear train includes harmonic drive, and the gear ratio between the rolls is adjusted by adjusting the speed of a trim motor having a rotational input into the harmonic drive.

Yet another object of the present invention is to provide a constant mesh gear train between the die roll and the anvil roll which is not affected by, and requires no adjustment as a result of, adjustment of the anvil roll axis towards or away from that of the die roll.

A feature by which this is attained is the employment at the end of a gear train between the die and anvil rolls of a gear concentric with the anvil roll and in constant mesh with and inside an internally toothed ring gear concentric with an axis about which the anvil roll axis is adjustable. This has the advantage that as the anvil roll axis is adjusted through an arc, for example by eccentrics, the internal gear moves in meshing engagement around the inside of the ring gear an equal arc. Preferably, this internal gear and the gear ring have a close gear ratio.

Yet a further object of the present invention is to provide for register adjustments of the die roll relative to the paperboards being die-cut, by an electric register when the machine is stopped, without having to move the anvil roll out of engagement with the die roll.

A feature by which this is achieved is the incorporation of a harmonic drive in a gear train between the die and anvil rolls, and rotating a wave generator cam of the harmonic drive by a trim motor interconnected with the electric register. In this arrangement, the trim motor rotates the anvil roll in synchronization with the die roll through part of the harmonic drive, even though the gear train as a whole is stopped. This has the advantage that register adjustments of the die roll can be effected, when the machine is stopped, without damaging the anvil roll while keeping the two rolls in correct engagement with each other.

Accordingly, therefore, there is provided by one aspect of the present invention a machine for processing sheets of paperboard and the like, comprising a rotatable die roll having at least one die blade, a rotatable anvil roll having a cover thereon, the anvil roll cooperating with the die roll for engagement of the cover by the die blade or blades, and gear means, connected between the die roll and the anvil roll, for causing the rolls to rotate in relation to each other, and for providing an infinite hunting ratio between the rolls to effectively cause the die blade or blades to engage the cover at a different peripheral location each and every revolution of the die roll and effectively eliminate any cyclic repeating pattern of engagement of the die blade with the cover.

The gear means may comprise a harmonic drive having a circular internally toothed spline, a dynamic internally toothed spline, a thin-walled externally toothed flexspline, and a wave generator cam. The flexspline is mounted on and flexibly conforms to the cam. The circular and dynamic splines may have a different number of teeth and are mounted side by side, the circular and dynamic splines both encircling and meshing with the flexspline. A trim motor preferably is rotatably connected, via reduction gearing, to the cam and may, inter alia, be controlled in relation to the thickness of the anvil roll cover. Alternatively, or in addition, a timing circuit, for example a pulse generator, may be included in control circuitry of the trim motor to effect periodic arbitrary speed increases or decreases thereof.

The gear means could be designed to accommodate a differential drive instead of the harmonic drive. The trim motor could then be drivingly connected to a rotary component of the differential drive.

According to another aspect of the present invention, there is provided a machine for processing sheets of paperboard and the like, comprising a die roll, an anvil roll having a cover thereon, the die roll and the anvil roll being rotatable about spaced apart axes, gear means, connected between the rolls, for establishing a gear ratio therebetween, a motor associated with the gear means, rotation for the motor effecting said gear ratio, and means for automatically and arbitrarily effecting a speed change of the motor from time to time for effecting arbitrary small changes in the speed of rotation of the anvil roll relative to the die roll.

According to yet another aspect of the present invention, there is provided a machine for die cutting sheets of paperboard and the like, comprising a rotatable die roll, a rotatable anvil roll having a resilient cover thereon and cooperating with the die roll for effecting die-cutting of paperboard sheets when passed therebetween, gearing interconnected between the rolls for establishing a gear ratio therebetween, means, responsive to changes in diameter of the anvil roll due to wear of the cover, for sensing such changes and for producing signals in response thereto and means, interconnected between the sensing means and the gearing, for changing said gear ratio in response to the signals. Advantageously, means may be provided for removing an outer layer off the cover to resurface the cover. The sensing means may be associated with the removing means and sense the change of diameter of the anvil roll upon removal of this outer layer.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

The present invention is particularly applicable to flexographic printer die-cutter machines for printing and die-cutting individual sheets of paperboard to form, for example, blanks for corrugated paperboard boxes. The preferred embodiments of the invention relate to the rotary die-cutting sections of such machines, although in its broader aspects the present invention is applicable to other apparatus in the corrugated paperboard industry and to other sections of flexographic machines.

Figure 1:
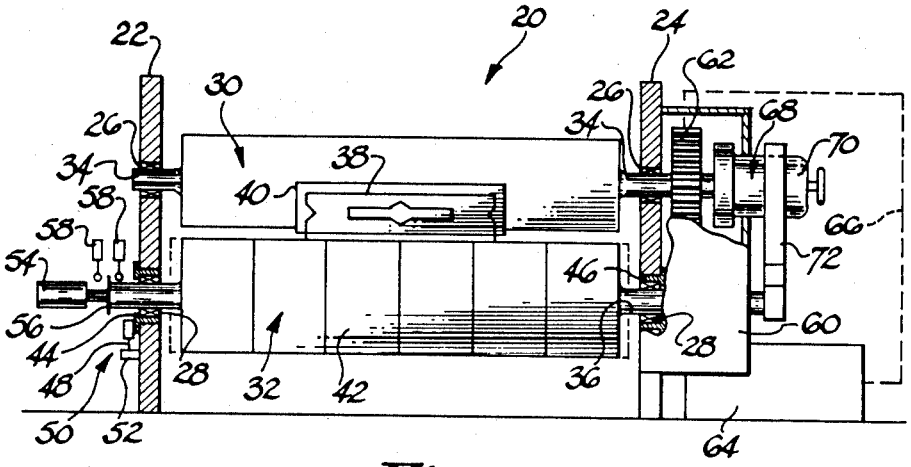
FIG. 1 is a simplified diagrammatic front elevational view of a rotary die-cut machine according to the present invention, with some parts being omitted, some parts being broken away, and other parts being shown in section.

FIG. 1 illustrates, in a somewhat simplified manner, a front view of a rotary die-cut machine 20 which forms a section of a flexographic machine. Two side frames 22, 24 rotatably support in pairs of bearings 26, 28 an upper cutting die roll 30 and a lower anvil roll 32. The rolls 30, 32 comprise metal cylinders mounted on shafts 34, 36. One or more cutting and/or scoring dies are mounted on the die roll 30, each die comprising cutting or scoring serrated metal blades 38 protruding radially from an arcuate plywood board 40 which is bolted to the cylinder of the die roll 30. The cylinder of the anvil roll 32 has a resilient cover 42 into which the blades 38 penetrate when cutting or scoring a carton blank. The cover 42 can be formed by a plurality of annular sections, as shown, or may be formed as a continuous cylinder, adhered around the cylinder of the anvil roll 32. Preferably the cover 42 is made of polyurethane having a radial thickness of about one third of an inch. The bearings 28 of the anvil roll 32 are mounted inside of eccentrics 44, 46, each eccentric being adjustably rotatably mounted in a bore in the respective side frame 22, 24. The eccentrics 44, 46 are manually rotatably adjusted to move the anvil roll 32 upward or downward to obtain the correct nipping relationship with the die roll 30, as will be described in greater detail later. A wiper contact 48 of a rotary rheostat 50 is mounted on the outer face of the eccentric 44 for rotational movement therewith; an arcuate resistor 52 of the rheostat 50 is non-movably mounted on the side frame 22 below and in contact with the wiper contact 48.

The anvil roll 32 is transversed axially as it rotates to vary the axial location at which the die blades 38 penetrate the resilient location at which the die blades 38 penetrate the resilient cover 42 each revolution. This axial traversing or oscillating motion and the manner of carrying it out are fully described in U.S. Pat. Nos. 3,272,047 and 4,240,312 the disclosures of which are hereby incorporated herein by reference. Briefly, the anvil roll shaft 36 is oscillated axially by a hydraulic cylinder 54 connected to the left-hand end thereof; a plate 56, mounted on the left-hand end of shaft 36, strikes and actuates a respective one of two electric limit switches 58 at the end of each axial stroke, the actuated limit switch then causing the hydraulic cylinder 54 to reverse its direction of drive. During each such stroke, the rotational speed of the anvil roll 32 may be both increased and then decreased as disclosed in U.S. Pat. No. 4,240,312.

At the right-hand side of the machine 20, a gear train is contained in a housing 60, the anvil roll 32 being driven by the die roll 30 through this gear train, as will be described in greater detail laer. This gear train commences with a spur gear 62 secured on the die roll shaft 34. The gear 62 is driven by the main drive motor 64 of the machine through suitable gearing illustrated schematically by a broken line 66. An electric register 68, including an electric motor 70, is mounted through the housing 60 and connected to the die roll shaft 34 for partially rotating the die roll 30 independently of the main drive motor 64 for adjusting the cutting blades 38 into correct register with the carton blanks being fed to the die-cut machine 20, as is well known. A trim motor 72 is mounted outside the housing 60 and provides an auxiliary trimming drive into the gear train in the housing 60 to alter the speed of rotation of the anvil roll 32, as will be described more fully later.

During operation of the above machine, the blades 38 penetrate part-way through the resilient cover 42 of the anvil roll 32 to obtain the desired cutting or scoring action, as is well known in the paperboard industry. In time, this causes the surface of the polyurethane cover 42 to deteriorate causing a reduction of thickness of the cover and consequently a slight reduction in diameter of the anvil roll 32. It has been found that for high quality processing of the paperboard sheets being fed through the machine, both rolls 30, 32 should be driven at the same circumferential speed as the speed at which the paperboard sheets are fed to the die-cutting section 20. Consequently, as the cover 42 wears and the diameter of the anvil roll decreases, it is desirable to increase the speed of rotation of the anvil roll so that the linear peripheral speed thereof is the same as the "effective" linear peripheral speed of the die roll 30. One aspect of the present invention involves determining the diameter of the anvil roll, or the remaining thickness of the resilient cover 42, and automatically changing the gear ratio between the die roll shaft 34 and the anvil roll shaft 36 in accordance therewith to compensate for wear of the cover 42.

Four embodiments for determining the diameter of the anvil roll 42 are illustrated respectively in FIGS. 1, 2, 3 and 4.

In the FIG. 1 embodiment, the rotational position of the eccentric 44 is sensed when the anvil roll is in correct nipping relationship with the die roll to determine the diameter and thus the peripheral speed of the anvil roll 32. When the eccentrics 44, 46 are rotated to correctly adjust the anvil roll 32 vertically with respect to the die roll 30, the wiper contact 48 of the rheostat 50 moves along the arcuate resistor 52. The change in effective resistance of the resistor 52 is used to provide an electrical signal which is used to influence the trim motor 72, as will be described more fully later.

Figure 2:
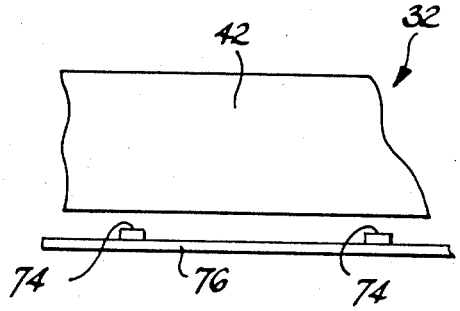
FIG. 2 is a diagrammatic front view of a portion of the machine of FIG. 1, and illustrating sonar heads for detecting the diameter of the anvil roll.

In the FIG. 2 embodiment, the distance of the periphery of the anvil roll 32 from one or more fixed locations is measured, and this measurement, or the average of these measurements, is used to provide a signal to control the trim motor 72. To achieve this measuring, two or more sonar heads 74 are spaced along a rigid bar 76 extending parallel to and just below the anvil roll 32. The sonar heads 74 are fixed a predetermined distance from the rotational axis of the anvil roll, and measure the radial distance of the heads 74 from the surface of the anvil cover 42. The bar 76 is attached at its ends to the side frames 22, 24.

In the FIG. 3 embodiment, again the distance of the periphery of the anvil roll 32 from one or more fixed locations is measured. However, in place of the sonar heads 74, one or more follower wheel units 78 are mounted on the rigid bar 76. Each unit 78 comprises a housing 80 in which is slidably mounted a radial arm 82 having a follower wheel 84 rotatably mounted at its radially inner end. Resilient means in the housing 80 urge the follower wheel lightly into rotational engagement with the surface of the resilient cover 42. A linear rheostat in the housing 80 is used to measure the extension of the arm 82 from the housing and provide a signal for influencing the trim motor 72.

In the FIG. 4 embodiment, again the distance between the anvil roll periphery and a datum position is measured. However, this measurement is advantageously combined with an operation of re-surfacing the anvil roll cover 42. The bar 76 in the FIG. 2 and 3 embodiments is replaced by a screw-threaded shaft 86 which is journalled in the side frames 22, 24. A traversing carriage 88 is mounted on the rod 86 for axial movement therealong upon rotation of the rod 86. Screw-threaded collars in the carriage 88 threadedly engage the screw-threaded rod 86 and are restrained against rotation to provide this movement. The rod 86 may be manually rotated, but is preferably driven by an auxiliary motor via reduction gearing or may be driven via a clutch from the anvil motor shaft. A hydraulic cylinder 90 is mounted vertically through the carriage 88 and operates a knife 92 extending vertically upwards immediately below the anvil roll 42. The hydraulic cylinder 90 can be operated, with manually controlled valves, from the same pumping unit that operates the hydraulic cylinder 54 for axially oscillating the anvil roll. To re-surface the resilient cover 42, the cylinder 90 is actuated until the point 94 of the knife 92 penetrates the cover 42 the appropriate radial distance to remove the deteriorated cover surface. The machine is then started and the anvil rod 32 rotates at operating speed. The rod is then rotated to traverse the knife 92 slowly along the length of the anvil roll to turn the surface layer off the cover 42. If necessary a return cutting traverse can be made. Further cutting traverses may be made, each time moving the cutting knife a very small incremental distance towards the axis of the anvil roll, until the cover 42 has been re-surfaced with a smooth surface of uniform diameter. The carriage 88 is then parked just beyond one end of the anvil roll. A linear rheostat is associated with the cylinder 90, a wiper contact of the rheostat moving with the knife 92 as the knife is extended by the cylinder 90. Thus the position of the wiper contact, after the last resurfacing cut is made, provides a measurement which is related to the new diameter of the anvil roll. This last setting of the rheostat is used to provide the re-surfaced anvil roll with a linear circumferential speed equal to that of the die roll 30, as will be explained more fully later.

FIGS. 5, 6, 7 and 8 illustrate the gear train from the die roll 30 to the anvil roll 32, including the trim motor and the adjustment of the eccentrics of the anvil roll.

Figure 5:
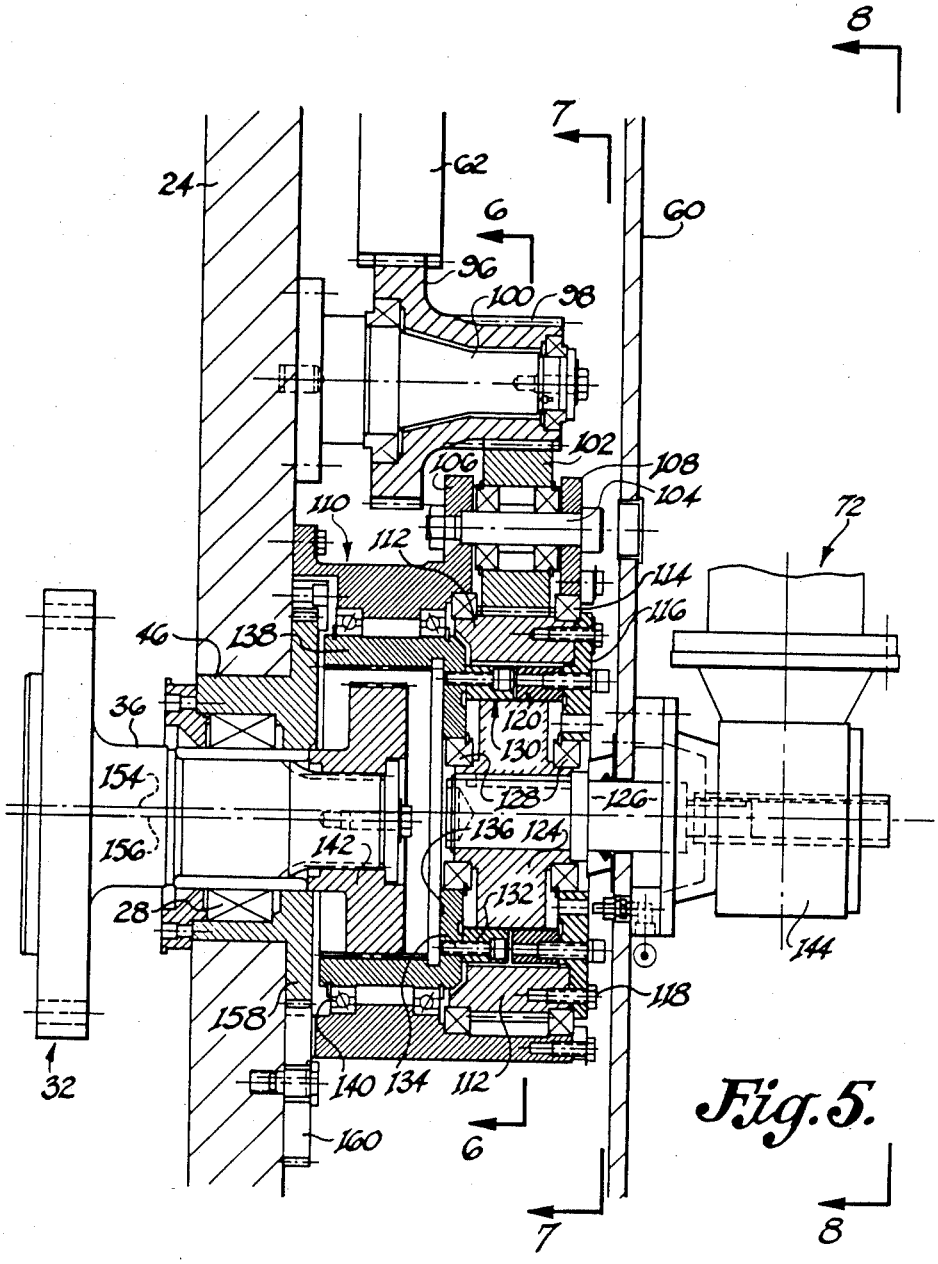
FIG. 5 is a section of the line 5—5 in FIG. 7 of the gear train which is located at the lower right-hand side of FIG. 1 for driving the anvil roll, some parts being shown in elevation for simplicity and clarity.

FIG. 5 shows a lower portion of the die roll gear 62 meshing with a smaller diameter gear 96 having integral therewith a yet smaller gear 98. The integral gears 96, 98 are journalled on a stub shaft 100 mounted on the side frame 24. The gear 98 meshes with an idler gear 102 rotatably mounted on a shaft 104 secured through flange ears 106, 108 of a stationary housing 110; the housing 110 is bolted to the side frame 24 around the anvil shaft 36 and eccentric 46, and contains further gearing. The idler gear 102 penetrates inside the housing 110 and meshes with an externally toothed gear ring 112 which is rotatably mounted in the housing 110 in a bearing 114. An annular flange 116 is secured by bolts 118 to the right-handside of gear ring 112. A circular spline 120 of a harmonic drive is secured by bolts 122 to the flange 116. The circular spline 120 is annular, extends axially approximately halfway through the gear ring 112, and has fine spline teeth around its radially inner circumference. An elliptical cam or wave generator 124 is keyed to an input shaft 126 and rotatably mounted in bearings 128 inside the housing 110. A flexspline 130 is mounted as a sliding fit over the cam 124. The flexspline is a thin walled elastic steel ring with fine external spline teeth that progressively engage the internal spline teeth of the circular spline 120 at diametrically opposite "lobes" of the elliptical cam 124. The flexibility of the flexspline 130 allows it to be distorted from an annular ring and conform to the elliptical profile of the cam 124. In FIG. 5, the thin walled flexspline 130 is depicted only as a thick line. Axially aligned with the circular spline 120 is a similar dynamic spline 132 being of annular shape and having fine internal spline teeth around its radially inner periphery; however, the number of spline teeth of the dynamic spline 132 is slightly different from the number of spline teeth of the circular spline 120. The spline teeth of the dynamic spline 132 also progressively engage the external spline teeth of the flexspline 130 at the diametrically opposite lobe portions of the elliptical cam 124. The dynamic spline 132 is secured by bolts 134 to a radially internally extending end flange 136 of an internally toothed ring gear 138. The ring gear 138 is rotatably mounted in two bearings 140 seated in the housing 110. One of the bearings 128, the left-handside one in FIG. 5, is seated inside the flange 136. An externally toothed gear 142, rigidly mounted on the anvil roll shaft 36, meshes with the internal teeth of ring gear 138. The die roll gear 62 drives the anvil roll shaft 36 through the gear train constituted by the gears 96, 98, 102, 112, 120, 130, 132, 138 and 142 in that sequence.

The trim motor 72 is drivingly connected, via a right angled reduction gear box 144, to the wave generator shaft 126. When the shaft, and so the wave generator cam 124, is stationary, the harmonic drive 120, 130, 132 has a constant, but externally close, gear ratio. Rotation of the cam 124 in either direction of rotation by the reversible trim motor 72 increases or decreases this gear ratio.

Figure 6:
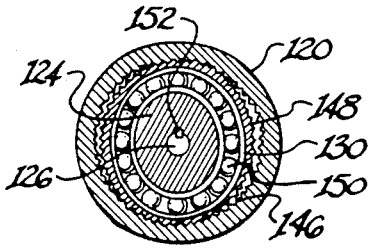
FIG. 6 is a diagrammatic section, on a smaller scale, on the line 6—6 in FIG. 5 of a harmonic drive portion of the gear train to the anvil roll.

FIG. 6 diagrammatically illustrates a cross-section through the harmonic drive on the line 6—6 of FIG. 5. The internal teeth 145 of the circular spline 120 can be seen meshing with the external teeth 148 of the flexspline 120 at opposite lobe portions of the cam 124. An elliptical ball bearing 150 forms the outer periphery of the elliptical cam 124, and the thin walled flexspline 120 conforms to this elliptical bearing 150 and is so freely rotatably relative to the cam 124. The flexspline flexes during such relative rotation to remain conformed to the elliptical shape of the bearing 150. During relative rotation between the cam 124, 150 and the circular spline 120, the elliptical shape of the cam 124 creates a type of wave form in the flexspline 20 which changes the angular position of engagement of the two opposite sections of flexspline teeth 148 with the engaging sections of circular spline teeth 146. A key 152 keys the cam 124 to the shaft 126. The relative radial thickness of the flexspline 130 has been exaggerated in FIG. 6 for clarity. The dynamic spline 132, similarly, but independently, engages the flexspline 130.

Harmonic drives, and the theory of their functioning, are known. One type of harmonic drive, having a single cup spline in place of the above circular and dynamic splines, is disclosed in U.S. Pat. Nos. 3,565,006; 3,882,745; 3,899,945; and 3,952,637 in relation to driving rolls in paperboard processing machines for producing carton blanks. U.S. Pat. No. 3,882,745 also discloses and explains the use of a motor to rotate the wave generator cam. U.S. Pat. No. 2,906,143 is an earlier patent directed to and discussing harmonic drives. For further details of the harmonic drive shown in FIGS. 5 and 6, reference is made to a brochure published by the Harmonic Drive Division, Emhart Machinery Group, 51 Armory Street, Wakefield, Mass. 01880 entitled Harmonic Drive Pancake Gearing and identified as Form #4000.

Returning to FIG. 5, the anvil roll shaft 36 journalled in the bearing 28 mounted in the eccentric 46 can more clearly be seen. The rheostat 50 has been omitted as the arrangement of FIG. 5 also applies to the embodiments of FIGS. 2, 3 and 4. The eccentric 46 is adjustably rotatable about an axis 154, which is the central axis of the bore in the side frame 24 in which the eccentric rotates. The shaft 36 rotates about an axis 156 which is the central axis of the bearing 28, the latter being seated in an eccentric cavity of the eccentric 46. The eccentric axis 156 is parallel to and spaced a short distance, for example 0.25 inch, from the axis 154. The gear 142 rotates on the eccentric axis 156. The eccentric 46 has an integral gear 158 at the end adjacent the gears 138, 142. The gear 158 meshes with and is rotatable by a gear 160 rotatably mounted to the side frame 24. The eccentric 44 at the other end of the anvil shaft 36 has an integral gear which meshes with a similar gear 160 (not shown). When the gears 160 are partially rotated in unison, for example via an input drive manually rotated by an operator, the eccentrics turn and the eccentric axis 156 partially rotates about the axis 154 to raise or lower the anvil roll 32 towards or away from the die roll 30. At the same time, the gear 142 rotates in mesh around the inside of ring gear 138 to a new position angularly displaced from its previous position. However, the repositioning of the gear 142 around the inside of the ring gear 138 does not change the gear ratio between the gears 138 and 142, that ratio remaining constant. As can be seen, the gear 142 is substantially narrower than the ring gear 138; this is to allow the gear 142 to slide axially inside the ring gear 142, while remaining in mesh therewith, during transverse oscillation of the anvil roll 32 by the hydraulic cylinder 54.

Figure 7:
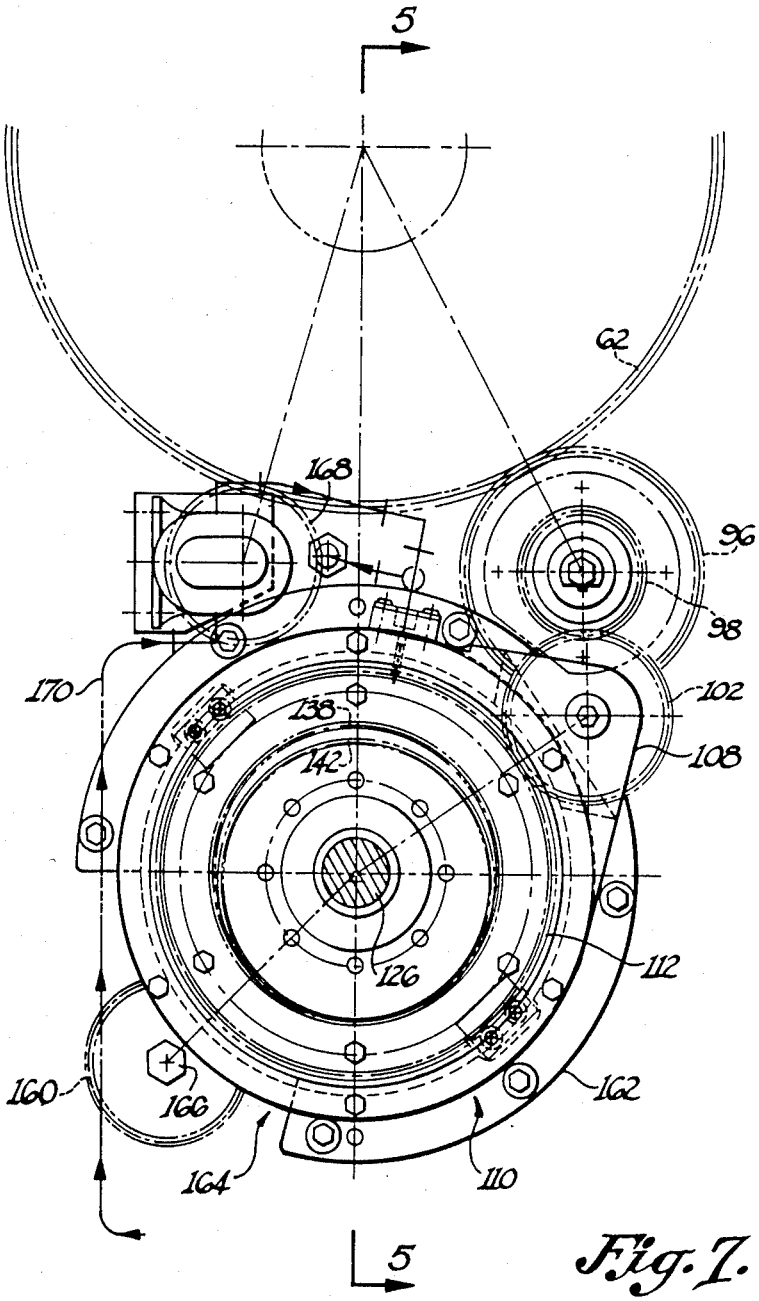
FIG. 7 is a diagrammatic view on the line 7—7 in FIG. 5 of the anvil roll gear train, some parts being shown in phantom for clarity.

FIG. 7 diagrammatically illustrates in end view the disposition and meshing of the gears 62, 96, 98, 102 and ring gear 112. Also, the meshing of the movable eccentrically mounted gear 142 inside the ring gear 138 is illustrated. The housing 110 has a mounting flange 162 provided with a circumferential cutout 164 to accommodate the adjustment gear 160 and its stub axle 166. A gear 168, also driven by the die roll gear 62, drives a lubricating pump for lubricating the gear train, a conduit 170 of this lubricating system is diagrammatically illustrated.

Figure 8:
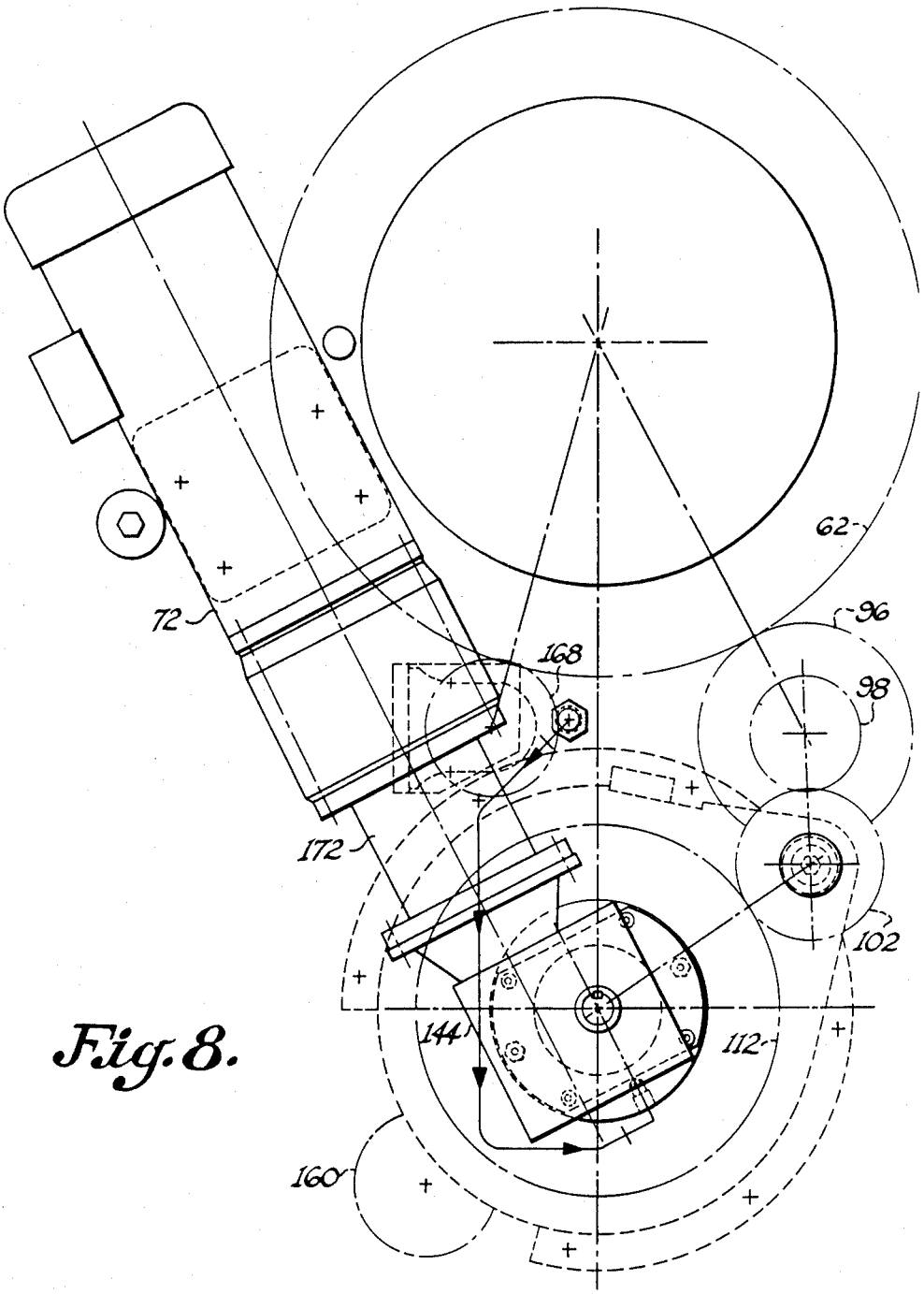
FIG. 8 is a diagrammatic view on the line 8—8 in FIG. 5 with some parts omitted and others shown in broken lines for simplicity and clarity.

FIG. 8, similarly to FIG. 7, illustrates in end view (with the housing 60 omitted) the disposition of the gears 62, 96, 98, 102, 112, 160 and 168. Also more clearly shown is the angular disposition of the trim motor 72 extending upwardly at an angle from the reduction gear box 144. Between the motor 72 and the gear box 144 is disposed a tachometer 172 for feeding back to a speed control system a signal representative of the actual speed of the trim motor 72, as will be discussed later.

Figure 9:
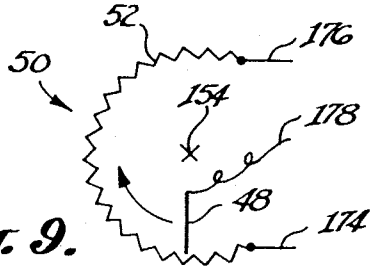
FIG. 9 is a schematic illustration of a rheostat arrangement in the embodiment of FIG. 1.

FIG. 9 diagrammatically illustrates the rotary rheostat 50 of FIG. 1. The stationary, arcuately disposed resistor 52 is shown having electrical leads 174, 176 connected to a voltage supply. The rotatable wiper contact 48 is rotatable about the central axis 154 of the eccentric 46 (FIG. 5) and has an electric output lead 178 which is connected to the control circuitry of the trim motor for supplying a signal indicative of the angular position of the eccentric.

Figure 3:
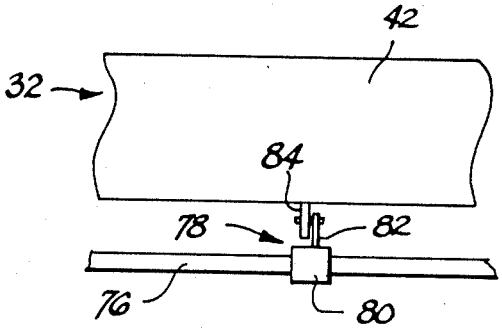
FIG. 3 is a view similar to FIG. 2 but illustrating an alternative follower wheel arrangement for detecting the diameter of the anvil roll.
Figure 4:
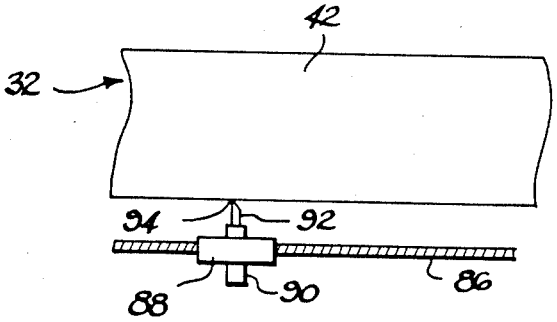
FIG. 4 is a view similar to FIGS. 2 and 3, but illustrating another alternative arrangement for detecting the diameter of the anvil roll, this arrangement including a knife for re-surfacing the anvil roll.
Figure 10:
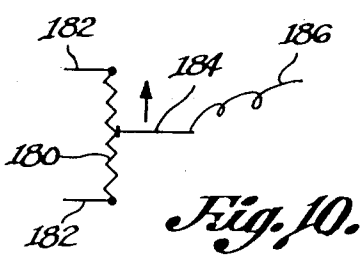
FIG. 10 is a schematic illustration of a rheostat arrangement in the embodiments of FIGS. 3 and 4.

FIG. 10 diagrammatically illustrates the linear rheostat employed in the FIG. 3 and FIG. 4 embodiments. A straight resistor 180 is connected across a suitable voltage supply by lead 182. A wiper contact 184, movable linearly along the resistor 180, taps off a signal voltage which is fed via output lead 186 to the control circuitry of the trim motor. The wiper contact 84 is connected for movement with the follower wheel arm 82 (FIG. 3) or the knife 92 (FIG. 4) to produce a signal indicative of the diameter of the anvil roll.

Figure 11:
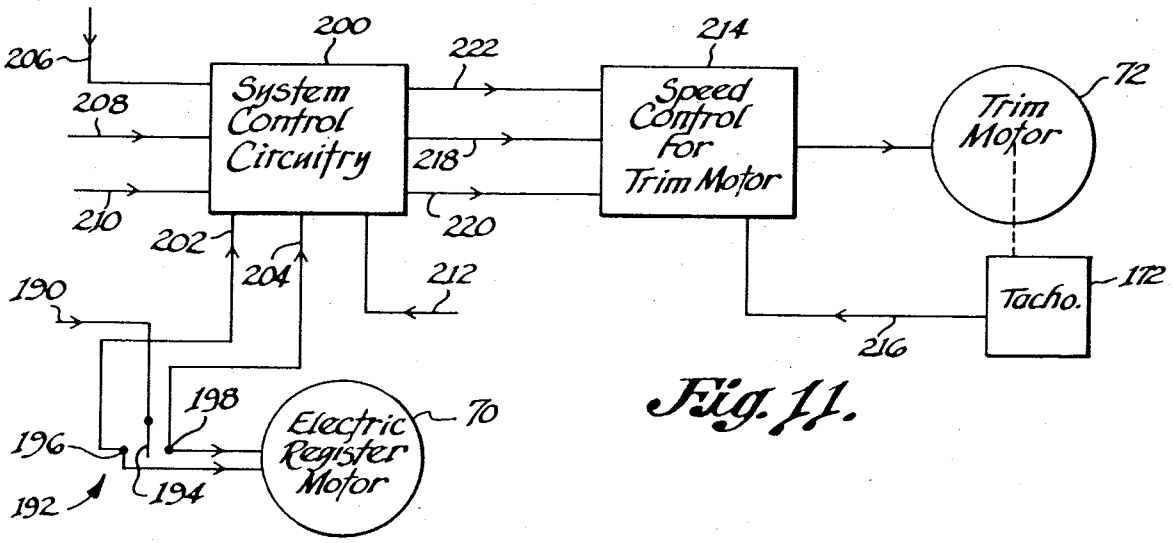
FIG. 11 is a simplified schematic diagram of the arrangement for controlling rotation of the anvil roll of the embodiments of FIGS. 1, 2, 3 and 4.

FIG. 11 is a simplified block schematic of the control circuitry for the trim motor 72 and a unique interrelation between the electric register motor 70, for rotating the die roll 30 to change the "register" thereof, and the trim motor 72. The power supply 190 to the electric register motor 70 is connected through a three position switch 192 shown with a movable contact 194 in a neutral position with the register motor 70 off. The switch 192 is normally resiliently biased open, and may be closed by and during depression of a forward push button or a reverse push button; this switch may take the form of a pair of normally open momentary push buttons, the register motor 70 being unenergized if neither push button is depressed. When the contact 194 is manually actuated to engage terminal 196, the register motor 70 runs in a forward direction, so driving the die roll in a forward direction of rotation. When the contact 194 is moved to engage the terminal 198, the register motor 70 runs in a reverse direction. When the register motor is running forward, an input 202 from the terminal 196 is fed to system control circuitry 200; when the register motor is in reverse, an input 204 from the terminal 198 is supplied to the system control circuitry 200. Other inputs to the system control circuitry 200 are main drive motor speed signal 206, anvil roll diameter signal 208, operator offset signal 210, and main drive motor running signal 212. The signal 206 is provided from a tachometer on the main drive motor 64 and indicates the throughput running speed of the machine. The anvil roll diameter signal 208 is provided from the rotary rheostat 50 (FIG. 1), the sonar heads 74 (FIG. 2), or the linear rheostat 180, 184 (FIGS. 3 or 4). The operator offset signal 210 is provided from a fine manual adjustment to the anvil roll speed which can be introduced via a manually adjustable rheostat to provide fine tuning of the machine. The signal 212 communicates that the main drive motor 64 is running and prevents any actuation of the electric register motor changing the anvil roll speed via the trim motor 72. The trim motor 72 is operated via a DC speed control (i.e. a DC drive) 214, and the tachometer 172 feeds back into the speed control 214 a signal 216 indicative of the actual speed of the trim motor 72. The system control circuitry 200 feeds either a forward signal 218 or a reverse signal 220 of the speed control 214 to determine the direction of rotation of the trim motor 72. The system control circuitry 200 also provides the speed control 214 with an input speed signal 222 from zero to 10 volts DC to determine the rotational speed of the trim motor 72.

In operation, the speed of the main drive motor 64 is set to determine the throughput speed of the machine, that is the linear speed at which individual paperboard sheets are conveyed through the machine. The vertical position of the anvil roll 32 is adjusted via the eccentrics 44, 46 for the correct nipping relationship with the die roll 30. This provides signals 206 and 208 to the system control circuitry 200. When the trim motor 72 is stationary, the gear train of FIG. 5 has an overall gear ratio such that the anvil roll 32 is rotated at a speed such that the linear peripheral speed of the anvil roll is equal to that of the die roll 30 when the thickness of the resilient cover 42 has a predetermined value, say 0.306 inch. If the signal 208 indicates that the diameter of the anvil roll is such that the thickness of the cover 42 is less than this predetermined value, then the signals 206 and 208 cause the system control circuitry 200 to supply a forward signal 218 and a speed signal 222 to the DC speed control 214 which results in the trim motor 72 rotating in the forward direction and at a determined continuous speed which increases the speed of rotation of the anvil roll 32 so that the linear peripheral speed of the anvil roll is the same as that of the die roll. Rotation of the trim motor 72 rotates the wave generator cam 124 (FIG. 5) which changes the effective gear ratio of the harmonic drive from the input circular spline 120 to the output dynamic spline 132 via the flexspline 130. Forward rotation of the cam 124 generates a wave motion in the flexspline 130 continuously progressing the diametrically opposite sections of the flexspline which mesh with the circular and dynamic splines 120, 130. Should the signal 208 indicate that the anvil roll diameter is such that the thickness of the resilient cover 42 is greater than the predetermined thickness, then the system control circuitry 200 would send a reverse signal 220 and a speed signal 222 to the DC speed control 214 to effect rotation of the trim motor in the reverse direction at a continuous speed to cause the anvil roll to be rotated at a decreased speed such that the linear peripheral speeds of the die and anvil rolls are the same. In this case the wave generator cam 124 would be continuously rotated in a reverse direction. Should the anvil roll diameter signal 208 indicate that the resilient cover thickness is at the predetermined value, such as a new cover having a thickness of 0.306 inch, then the system control circuitry sends a zero speed signal to the DC speed control 214 and the trim motor 72 is not energized and remains stationary. If desired, an electronic or mechanical brake may be incorporated in the trim motor 72 and may be automatically applied to the trim motor when the latter is deenergized.

Should there be a failure in the control system, then the trim motor 72 would remain unenergized and braked. However, this would still allow the rotary die-cut machine 20 to operate and continue to process carton blanks. The anvil roll 32 would be positively driven by the gear train of FIG. 5 at its default gear ratio with the wave generator cam 124 stationary. The quality of the carton blanks so produced may suffer due to different linear surface speeds of the anvil and die rolls, but production could be continued until the failure of the control system was repaired; this being a management choice of producing possibly poorer quality carton blanks as opposed to production being stopped.

The operator offset signal 210 is used to provide a very fine vernier type adjustment should the quality of the carton blanks produced indicate that this is desirable. Such adjustment usually being made, if necessary, when a new processing specification is first set-up on the machine at the beginning of a new production run. However, if desired, the operator offset signal and the manual control therefor could be designed to allow full operator adjustment of the anvil roll speed.

During the set-up at the beginning of a production run, or after the machine has been stopped for repair such as replacing the die board 40 or the cover 42, it may be necessary to adjust the register of the die blades 38 in relation to the movement through the machine of the paperboard sheets being processed into carton blanks. The electric register 68 is usually provided for this purpose. However, the electric register only rotates the die roll 30, so that in the past it has been necessary, when the machine is not running, to move the anvil roll out of nipping relationship with the die roll before adjusting the rotational position of the die roll. This disengagement of these rolls being necessary because the die blades penetrate the resilient cover of the anvil roll, and would severely damage this cover if not disengaged therefrom when the anvil roll is stationary and the die roll is rotated. It should be noted that as the die roll gear 62 is connected via gearing 66 (FIG. 1) to the main drive motor 64 of the machine, and the machine usually has other sections, e.g. printing, slotting, etc., also connected to the main drive motor is to be driven thereby, the electric register 68 is arranged only to rotate the die roll 30 without rotation of the die roll gear 62, as is well known.

In accordance with an aspect of the present invention, when the register motor 70 is energized via the switch 192, a forward or reverse signal 202 or 204 is supplied to the control system circuitry 200 depending upon whether the register motor 70 is energized for forward or reverse rotation. A signal 212 is also supplied to the control system circuitry 200 indicating that the main drive motor 64 is stopped. This results in a reverse or forward signal 220 or 218 being transmitted to the DC speed control 24 together with a fixed speed signal 222 (the register motor slowly rotating the die roll 30 at a fixed speed). This results in the trim motor 72 being rotated at a selected speed in the respective reverse or forward direction. This selected speed is chosen so that the wave generator cam 124 causes the anvil roll 32 to be rotated at the same peripheral speed as the die roll. Thus, with the machine not running, the actuation of the electric register motor 70 effects cooperative rotation of both the die roll and the anvil roll, so eliminating the previous need to separate these rolls during a registering adjustment.

As will be appreciated, when the die roll gear 62 is stationary, the circular spline 120 (FIG. 5) remains stationary. In this situation, rotation of the wave generator cam 124 by the trim motor 72 causes the dynamic spline 123 to be rotated in the same direction due to the wave motion imported to the flexspline 130. The dynamic spline 132 thus rotates the anvil roll shaft 36 in the same direction via the ring gear 138 and the gear 142 rotated thereinside. Thus, the harmonic drive 120, 130, 132 is operated in a different mode of transmission when the trim motor 72 is energized by actuation of the electric register motor.

Should the register motor 70 be actuated while the main drive motor 64 is running, the signal 212 to the system control circuitry 200 indicative of a running main drive motor prevents the electric register signal (202 or 204) having any influence on the system control circuitry 200. Consequently, actuation of the electric register motor 70, when the main drive motor is running, has no influence of the control signals being transmitted by the system control circuitry 200 of the DC speed control 214.

Figure 12:
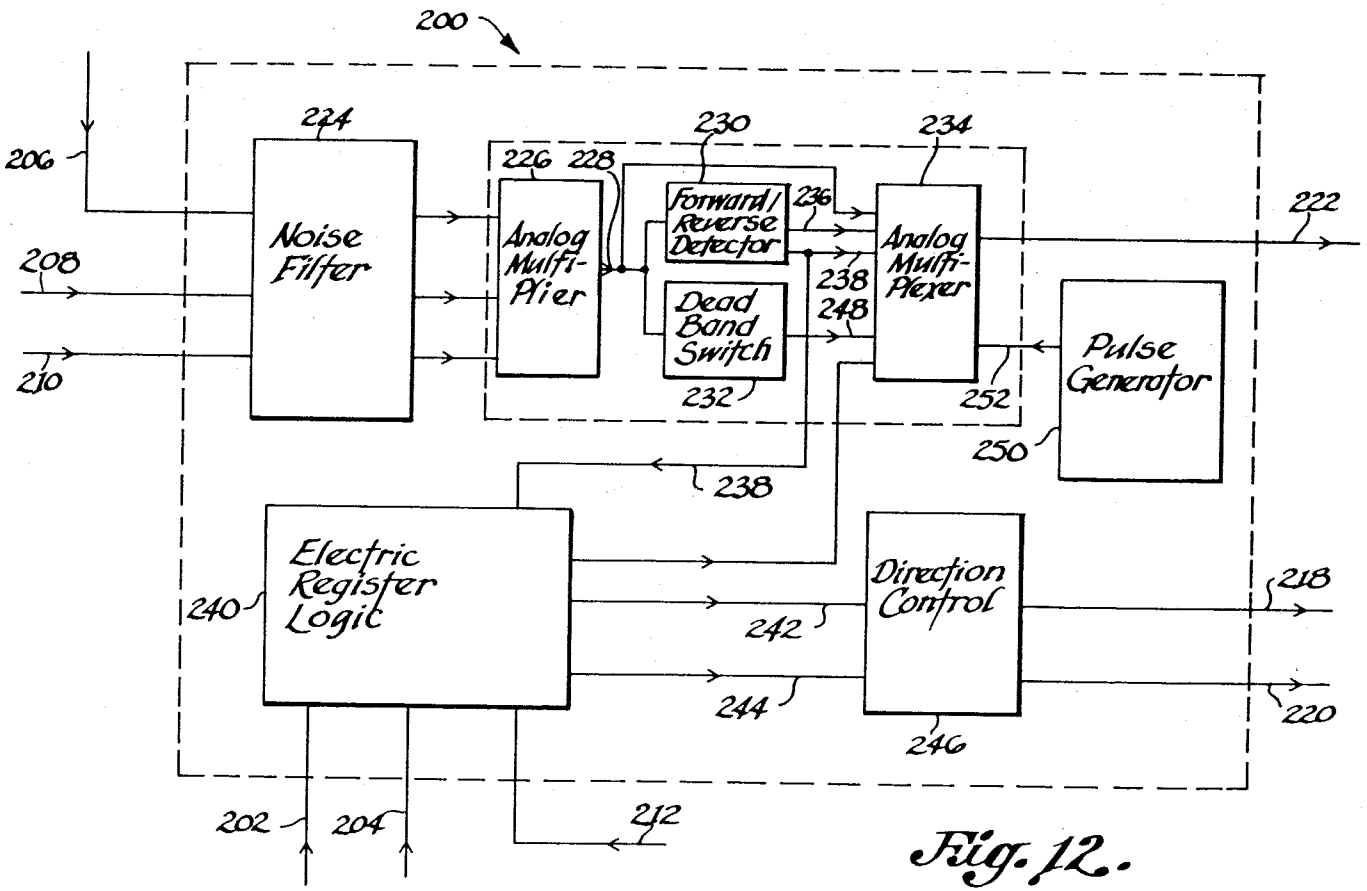
FIG. 12 is a schematic block diagram of the system control circuitry of the arrangement of FIG. 11.

FIG. 12 illustates in simplified block schematic form the different interrelated functions performed by the system control circuitry 200 which comprises a printed circuit board having appropriate chips mounted thereon. The main drive motor speed signal 206, the anvil roll diameter signal 208, and the operator offset signal 210 are fed through an analog input noise filter 224 to an analog multiplier 226 which produces a multiplied and conditioned output signal 228. This signal 228 is fed to a forward/reverse detector 230, a dead band switch 232, and an analog multiplexer 234. The forward/reverse detector 230 determines from the polarity of the signal 228 whether the trim motor needs to be operated in the forward or reverse direction. The detector 230 supplies a signal 236 to the analog multiplexer 234 which is an inverted version of the signal 228. The detector 230 also supplies a signal 238 to the analog multiplexer 234, the signal 238 being low for forward rotation of the trim motor and high for reverse rotation. When the signal 238 is low the multiplexer 234 uses the speed signal 228 which is then positive. The high/low signal 238 is also supplied to an electric register logic 240 which in turn supplies a forward run signal 242 or a reverse run signal 244 to a direction control 246. The direction control includes a pair of relays in parallel which have a common voltage supply from the DC speed control 214 (FIG. 11), one of these relays being closed by the signal 242 to supply the forward run signal 218 to the trim motor, and the other relay being closed by the signal 244 to supply the reverse run signal 220 to the trim motor. The dead band switch 232 provides a signal 248 to the multiplexer 234, the signal 248 being low when the speed requested for the trim motor is above a low speed dead band value and allowing the DC speed control to receive a run signal. However, when the speed requested for the trim motor is in the dead band range of the trim motor, that is below a critical low speed for that motor, the signal 248 becomes high causing the multiplexer to provide a zero volt output signal 222 to stop the trim motor and prevent damage thereto. A pulse generator 250 produces a periodic pulse, for example for one second in every ten seconds, which is supplied as a signal 252 to the multiplexer to periodically produce a change in speed of the trim motor, for example to produce in the anvil roll an increase of one or two revolutions per minute during one second in every ten seconds. That is, the trim motor speed increases for one second and then reverts to its former speed for the next nine seconds, this pattern continually repeating to effect an infinite hunting ratio between the die roll and the anvil roll as will be discussed more fully later. The analog multiplexer 234 takes the various input signals 228, 236, 238, 248, and 252 and produces therefrom the speed control signal 222 to the DC speed control 214. Due to the reduction gearing of the trim motor, and the gear reduction of the trim motor drive through the harmonic drive to the anvil roll, 620 revolutions of the trim motor produces 1 revolution of the anvil roll.

When the electric register control is manually actuated to produce either the signal 202 or the signal 204, the signal is supplied to the electric register logic 240. Provided the main drive motor is not running (the signal 212 then being +24 volt DC), the logic 240 supplies a forward or reverse run signal 242, 244 to the direction control 246 corresponding to the forward or reverse signal 202, 204, respectively. As discussed above, this actuates one or other of the two relays in the direction control 246 to provide the forward run signal 218 or the reverse run signal 220. The electric register logic 240 also provides, in response to either of the signals 202, 204, a speed signal 254 which is supplied to the multiplexer 234 to provide a speed control output signal 222 of a low voltage contant value to operate the trim motor at a medium to slow constant speed—the direction of rotation of the trim motor being determined by the signal 218 or 220.

However, if the main drive motor is running, the "main drive motor not running" signal 212 has a zero value; this inactivates the output signal 254 causing the signal 254 to have no influence on the analog multiplexer 234 when the electric register is activated. In other words, activation of the electric register when the main drive motor is running, does not change the speed of the trim motor; if the trim motor was stopped it remains stopped, but if the trim motor was running it continues to run at the same speed and in the same direction.

In the preferred embodiment of the control system of FIGS. 11 and 12, the trim motor 72 is a 1 HP (approx.) DC motor supplied by Hampton Products Co. Inc. of 2995 Eastbrook Drive, Rockford, Ill. 61109, and having a maximum speed of 1,750 rpm. The DC speed control is also supplied by Hampton Products under the designation VARISPEED 160, operates on a 110 volt AC supply and provides a 90 volt DC output to the trim motor. However, modification is necessary to enable forward and reverse signals from the tachometer 172 to be identified and utilized. In the system control circuitry, the noise filter 224 includes three Motorola MC 1458 dual operational amplifier chips; the analog multiplier 226 is supplied by Analog Devices under catalog number AD 534K; the forward/reverse detector 230 includes a Texas Instruments LM 311 comparator chip; the dead band switch 232 includes a Texas Instruments LM 393 dual comparator chip; the analog multiplexer 234 is supplied by Analog Devices under catalog number AD 7510KN; the pulse generator 250 contains a Motorola MC 1455 timer chip with a potentiometer for adjusting the pulse time; the electric register logic 240 contains three digital logic Motorola 4N33 optoisolator chips, a Motorola MC 14081B ANDgate chip, a Motorola MC 14049B inverter chip, and a Motorola MC 14071B ORgate chip; and the direction control 246 includes an Intersil ULN 2001 hexdriver chip and two Aromat type SA printed circuit board mount relays. The system control cicuitry 200 is mounted on a printed circuit board which is supplied with +15 volt DC and −15 volt DC.

The pulse generator 250 enables an infinite hunting ratio to be provided between the die roll 30 and the anvil roll 32. This can be employed to virtually eliminate any cyclic repetition of the position on the peripheral surface of the anvil roll at which the die blades 38 enter. The pulse period, frequency and value can be chosen so that on each successive revolution of the anvil roll, or after a few such revolutions, the die blades engage the resilient cover 42 at a position one or a few thousandths of an inch removed from the previous position of engagement. Cutting and wear of the resilient cover 42 is thereby reduced, the cover gradually wears more uniformly around its entire periphery, and the life of the cover 42 is increased. The pulse generator 250 may, for example, be adjusted to produce a one second pulse in every ten seconds, and the pulse may have a value to operate the trim motor 72 at half its full speed, i.e. 875 rpm. In conjunction with the default gear ratio between the die roll and the anvil roll, that is the gear ratio when the trim motor 72 is not running, the diameter of the die roll, and the speed of the main drive motor 64, the pulse generator can ensure that effectively an infinite hunting ratio, in relation to the life of the anvil roll cover, is provided. The periodic impulse supplied by the pulse generator, may be of the nature of a random impulse to make small random changes in speed of the trim motor.

Turning now to the gear train between the die roll and the anvil roll. In earlier prior art gear trains the die roll gear 62 meshed directly with a similar gear on the anvil roll shaft. These two gears had one tooth difference, e.g. the die roll gear had 131 teeth and the anvil roll gear had 130 teeth, to provide a one tooth hunting ratio between the die roll and the anvil roll. With this arrangement, the anvil roll and the die roll should have diameters in the ratio 131:130 to provide the two rolls with the same nominal linear peripheral speed when rotating. However, the position in which the die blades cut or engage the anvil roll cover would form a repeating pattern every 130 revolutions of the anvil roll.

In FIG. 5, the gear train between the die roll and the anvil roll has an infinite hunting ratio, even when the trim motor is stopped and braked. This is achieved by having multiple pairs of gears, with at least one of these pairs, and preferably two pairs, having a close gear ratio, whereby the overall gear ratio of the train is a number having an infinite number, or very large number, of places of decimals. That is, an infinite hunting ratio in relation to the number of revolutions in a life cycle of the anvil cover, whereby the cover is substantially worn (and needs to be resurfaced or replaced) before any effective cyclic repetition of the cutting position of the die blades on the cover occurs. Also, in the gear train, one and preferably two pairs of gears have fairly wide gear ratios. The help understand this concept, the number and pitch of the teeth of the gears in the FIG. 5 gear train is set out below:

| | | |
|---|---|---|
| die roll gear 24 | 126 teeth, 6 pitch | |
| gear 96 | 41 teeth, 6 pitch | |
| gear 98 | 28 teeth, 8 pitch | |
| idler gear 102 | 38 teeth, 8 pitch | |
| ring gear | 92 teeth, 8 pitch | |
| circular spline 120 | 266 spline teeth | harmonic drive |
| flexspline 130 | 264 spline teeth | harmonic drive |
| dynamic spline 132 | 264 spline teeth | harmonic drive |
| ring gear 138 | 99 teeth, 12 pitch | |
| internal gear 142 | 93 teeth, 12 pitch | |

With the trim motor stopped, and so the wave generator cam 124 stationary, the gear ratio through the harmonic drive from the circular spline 120 to the dynamic spline 132 is 133:132. Thus, the overall default gear ratio from the die roll to the anvil roll is:

$$\frac{126}{41} \times \frac{28}{92} \times \frac{133}{132} \times \frac{99}{93}$$

i.e. 1.0031982 . . .

In this gear train there are two "pairs" of gears each having a close gear ratio, namely the harmonic drive with 133:132, and the "eccentric" gears 138, 142 with 99:93. Also, there are two pairs of gears having a fairly wide gear ratio, namely gears 62, 96 with 126:41, and gears 98, 112 with 28:92.

The diameter of the die roll 30 is 21.008 inches, and the diameter of the anvil roll 32 is slighty smaller at 20.941 inches. Thus, with a new resilient cover 42 having a radial thickness of 0.306 inches, the linear peripheral speeds of the die and anvil rolls are the same with the default gear ratio of 1:1.0031982 . . . As the resilient cover wears, the eccentrics 44, 46 are adjusted and the trim motor 72 automatically operated to maintain these linear peripheral speeds the same with an infinite hunting ratio between the two rolls. Should a cover thickness greater than 0.306 inch, e.g. 0.420 inch, be employed then the trim motor would run in reverse until the cover thickness reduced by wear to 0.306 inch. The minimum thickness of the cover at which it should be replaced has been found to be 0.160 inch since the die blades penetrate into the cover about 0.07 inch.

It will be appreciated that in the gear train between th die and anvil rolls, constant mesh coupling of all the gears is employed. The pair of "eccentric" output gears comprising ring gear 138 and eccentric internal gear 142 not only allow uninhibited axial oscillation of the anvil roll, but also automatically accommodate change in vertical position of the anvil roll on rotation of the eccentrics 44, 46.

Even though a complex gear train is employed, the combination of having the eccentric gear 142 inside the gear ring 138 and the pancake gearing of the harmonic drive (i.e. a circular input spline and a dynamic output spline side by side) enables this gear train to be compactly packaged. It should be noted that this pancake gearing type harmonic drive occupies significantly less axial space than the cup spline type employed in the U.S. patents referred to above. The overall axial dimension of the eccentric and ring gears 142, 138 and the harmonic drive 120, 130, 132 together is only a little greater than the axial dimension of a cup spline type harmonic drive.

It will be appreciated, therefore, that the above preferred embodiments of the invention provide automatic infinite speed adjustment of the anvil roll with respect to cover wear, a hunting ratio to virtually eliminate any cyclic repeating pattern of the die blades thus extending anvil cover life, a constant mesh gear train that automatically accommodates height adjustment of the anvil roll, the capability of maintaining nipping engagement of the anvil roll with the die roll when the electric register is operated, and the capability of the machine still running in production should the control system or the trim motor inadvertently fail.

It should be particularly noted that proper speed of the anvil roll with respect to the die roll is maintained as the anvil roll cover wears. It will be appreciated that, within narrow limits, a slight difference in linear peripheral speed of the die and anvil rolls is permissible without perceptibly affecting the quality of die-cutting of the paperboard sheets. The present invention provides several specific approaches for maintaining the anvil roll peripheral speed within such narrow limits of the die roll throughout the life of the anvil roll cover.

It will be further appreciated, that the present invention also provides for reduced anvil roll cover wear while at the same time maintaining the anvil roll peripheral speed the same as that of the die roll. This is achieved by the unique concept of sensing the diameter of the anvil roll and employing this sensing to adjust an infinite hunting ratio.

The above described embodiments, of course, are not to be construed as limiting the breadth of the present invention. Modifications, and other alternative constructions, will be apparent which are within the spirit and scope of the invention as defined in the appended claims.

What is claimed is:

1. A machine for processing sheets of paperboard and the like, comprising:

a die roll;

an anvil roll ahving a cover thereon, said die roll and said anvil roll being rotatable about spaced apart axes;

gear means, connected between said die roll and said anvil roll, for establishing a gear ratio between said rolls;

a motor associated with said gear means, rotation of said motor affecting said gear ratio; and means for automatically and arbitrarily effecting a speed change of said motor from time to time for effecting arbitrary small changes in the speed of rotation of said anvil roll relative to said die roll from time to time.

2. The machine of claim 1, wherein said gear means comprises a plurality of constant mesh gears.

3. The machine of claim 2, wherein at least one pair of said gears has a close gear ratio therebetween, and at least another pair of said gears has a wide gear ratio therebetween.

4. The machine of claim 1, wherein said gear means includes a harmonic drive, and said motor is drivingly connected to a component of the harmonic drive for rotation of that component.

5. The machine of claim 4, wherein said harmonic drive comprises a circular internally toothed spline, a dynamic internally toothed spline, a thin-walled externally toothed flexspline, and a wave generator cam, said flexspline being mounted on and conforming to said cam, said circular and dynamic splines having a different number of teeth and being mounted side by side, and said circular and dynamic splines both encircling and meshing with said flexspline.

6. The machine of claim 4, wherein said arbitrarily varying means comprises a pulse generator in control circuitry of said motor.

7. A machine for processing sheets of paperboard and the like, comprising:

a rotatable die roll having at least one blade mounted thereon;

a rotatable anvil roll having a cover thereon, and cooperating with said die roll for engagement of said cover by said blade;

gear means, connected between said die roll and said anvil roll, for causing said rolls to rotate in relation to each other, and for providing an infinite hunting ratio between said die roll and said anvil roll to effectively eliminate any cyclic repeating pattern of engagement of said blade with said cover;

said gear means including a harmonic drive;

said harmonic drive comprising a circular internally toothed spine, a dynamic internally toothed spline, a thin-walled externally toothed flexspline, and a wave generator cam, said flexspline being mounted on and conforming to said cam, said circular and dynamic splines having a different number of teeth and being mounted side by side, and said circular and dynamic splines both encircling and meshing with said flexspline;

a trim motor drivingly connected to said cam for rotation thereof; and means, responsive to changes in diameter of said anvil roll as said cover wears, for providing a signal to said trim motor to control the speed thereof for effecting rotation of said die and anvil rolls at the same linear peripheral speed.

8. The machine of claim 7, further comprising means for periodically varying the speed of said trim motor independently of said signal.

9. The machine of claim 8, wherein said periodically varying means comprises a pulse generator.

10. The machine of claim 3, wherein:

said gear means further includes a second pair of gears having a close gear ratio and comprising an internally toothed ring gear meshing with a smaller externally toothed gear rotatably mounted eccentrically inside said ring gear;

said smaller gear is secured to a shaft of said anvil roll and is coaxial therewith; and said shaft is mounted in eccentrics which are adjustably rotatable for adjusting the distance between spaced apart rotational axes of said anvil roll and said die roll.

11. A machine for processing sheets of paperboard and the like, comprising:

a rotatable die roll having at least one blade mounted thereon;

a rotatable anvil roll having a cover thereon, and cooperating with said die roll for engaging of said cover by said blade;

gear means, connected between said die roll and said anvil roll, for causing said rolls to rotate in relation to each other, and for providing an infinite hunting ratio between said die roll and said anvil roll to effectively eliminate any cyclic repeating pattern of engagement of said blade with said cover;

said gear means including a harmonic drive having a rotatable wave generator cam, and a trim motor drivingly connected to said cam for rotation thereof; and means for automatically changing the speed of said trim motor.

12. The machine of claim 11, comprising means for controlling the speed of said trim motor at a determined speed, and wherein said changing means comprises a pulse generator connected to said controlling means for arbitrarily varying said determined speed.

13. A machine for die cutting sheets of paperboard and the like, comprising:

a rotatable die roll;

a rotatable anvil roll having a resilient cover thereon and cooperating with said die roll for effecting die cutting of said sheets when passed therebetween;

gearing interconnected between said die roll and said anvil roll for establishing a gear ratio therebetween during rotation of said rolls;

means, responsive to changse in diameter of said anvil roll due to wear of said cover, for sensing such changes and for producing a signal in response thereto; and means, interconnected between said sensing means and said gearing, for changing said gear ratio in response to said signal.

14. The machine of claim 13, further comprising:

means, associated with said anvil roll, for removing an outer layer off said cover to provide a new surface on said cover; and said sensing means being associated with said removing means and sensing the change of diameter of said anvil roll upon removal of said outer layer.

15. The machine of claim 13, further comprising:

a frame in which said die and anvil rolls are rotatably mounted;

at least one bushing rotatably mounted in said frame and having an eccenric bore therein;

said anvil roll having a shaft mounted in said bore;

means for adjustably rotating said bushing for moving said anvil roll towards said die roll to adjust said cooperating of said anvil roll with said die roll; and said sensing means being associated with said bushing for sensing the rotational position thereof relative to said frame.

16. The machine of claim 15, wherein said sensing means comprises a rheostat.

17. The machine of claim 13, wherein said sensing means comprises at least one sonar head.

18. The machine of claim 13, wherein said sensing means includes a follower wheel urged towards and into rotational engagement with said cover.

19. The machine of claim 13, wherein said sensing means includes a rheostat.

20. The machine of claim 13, wherein:

said gearing includes an internally toothed ring gear meshing with a smaller externally toothed gear mounted eccentrically inside said ring gear;

said smaller gear being secured to said anvil roll for rotation coaxially therewith; and said die roll and said anvil roll rotate about spaced apart parallel axes; and further comprising:

eccentric means, mounted on a frame of the machine, for adjusting the distance between said axes, said eccentric means being rotatable coaxially relative to said ring gear for effecting said adjusting, and said smaller gear moving with said anvil roll but remaining in mesh with said ring gear during said adjusting.

21. The machine of claim 20, further comprising means for axially oscillating said anvil roll relative to said die roll, said smaller gear being narower than said ring gear to accommodate axial oscillatory movement inside said ring gear of said smaller gear with axially oscillatory movement of said anvil roll.

22. The machine of claim 13, wherein said gearing includes a harmonic drive having a rotatable wave generator cam, and a trim motor drivingly connected to said cam for rotation thereof, said means for changing said gear ratio including said trim motor.

23. A machine for processing sheets of paperboard and the like, comprising:

a rotatable die roll having at least one blade mounted thereon;

a rotatable anvil roll having a cover thereon, and cooperating with said die roll for engagement of said cover by said blade;

gear means, connected between said die roll and said anvil roll, for causing said rolls to rotate in relation to each other, and for providing an infinite hunting ratio between said die roll and said anvil roll to effectively eliminate any cyclic repeating pattern of engagement of said blade with said cover;

said gear means including a harmonic drive having a rotatable wave generator cam, and a trim motor drivingly connected to said cam for rotation thereof;

an electric register manually actuable for rotating said die roll to change register thereof relative to said sheets being processed;

means for controlling the speed of said trim motor; and means, interconnected between said electric register and said speed controlling means, for effecting rotation of said trim motor when said die roll is only being rotated by said electric register and is disengaged from said gear means, and for causing said trim motor to rotate said anvil roll via said harmonic drive in synchronization with rotation of said die roll by said electric register.

24. A machine for processing sheets of paperboard and the like, comprising:

a rotatable die roll having at least one blade mounted thereon;

a rotatable anvil roll having a cover thereon, and cooperating with said die roll for engagement of said cover by said blade;

gear means connected between said die roll and said anvil roll, for causing said rolls to rotate in relation to each other, and for providing an infinite hunting ratio between said die roll and said anvil roll to effectively eliminate any cyclic repeating pattern of engagement of said blade with said cover;

means for sensing the anvil roll and for producing a signal indicative of the diameter of said anvil roll; and means for changing said hunting ratio responsive to said signal to compensate for any change in said diameter due to wear of said cover.

25. A machine for processing sheets of paperboard and the like, comprising:

a rotatable die roll having at least one blade mounted thereon;

a rotatable anvil roll having a cover thereon, and cooperating with said die roll for engagement of said cover by said blade;

gear means, connected between said die roll and said anvil roll, for causing said rolls to rotate in relation to each other, and for providing an infinite hunting ratio between said die roll and said anvil roll to effectively eliminate any cyclic repeating pattern of engagement of said blade with said cover;

a surface trimming knife;

means for supporting said knife and for moving said knife in contact with said cover axially across said anvil roll to remove the surface of said cover, when worn by said blade, and so provide a new surface;

means for sensing the position of said knife radially with respect to said anvil roll at the completion of removal of the worn cover surface; and means, connected to said sensing means and responsive thereto, for changing said hunting ratio in response to the sensed position of the knife.

* * * * *

UNITED STATES PATENT AND TRADEMARK OFFICE

CERTIFICATE OF CORRECTION

PATENT NO. : 4,736,660

DATED : April 12, 1988

INVENTOR(S) : Benach et al

It is certified that error appears in the above-identified patent and that said Letters Patent is hereby corrected as shown below:

Front page: under the heading [56] References Cited, below "U.S. PATENT DOCUMENTS" and above "3,272,047 9/1966 Ward" insert --2,906,143 9/1959 Musser--.

In Claim 1: at column 16, line 59, change "ahving" to --having--.

In Claim 7: at column 17, line 41, change "spine" to --spline--.

In Claim 11: at column 18, line 10, change "engaging" to --engagement--; and at column 18, line 22, after "automatically" insert --arbitrarily--.

In Claim 13: at column 18, line 38, change "changse" to --changes--.

In Claim 21: at column 19, line 24, change "narower" to --narrower--.

Signed and Sealed this

Twenty-ninth Day of November, 1988

*Attest:*

*Attesting Officer*

DONALD J. QUIGG

*Commissioner of Patents and Trademarks*